US008676067B2

(12) United States Patent
Maruyama et al.

(10) Patent No.: US 8,676,067 B2
(45) Date of Patent: Mar. 18, 2014

(54) IMAGE FORMING APPARATUS

(75) Inventors: Tsuyoshi Maruyama, Nagoyashi (JP); Katsumi Inukai, Iwakura (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 189 days.

(21) Appl. No.: 13/075,697

(22) Filed: Mar. 30, 2011

(65) Prior Publication Data

US 2012/0051762 A1 Mar. 1, 2012

(30) Foreign Application Priority Data

Aug. 31, 2010 (JP) ..... 2010-194139

(51) Int. Cl.
*G03G 15/02* (2006.01)

(52) U.S. Cl.
USPC ..... 399/31; 399/50; 399/171

(58) Field of Classification Search
USPC ..... 399/31, 50, 89, 171
See application file for complete search history.

(56) References Cited

U.S. PATENT DOCUMENTS

| | | | | |
|---|---|---|---|---|
| 4,891,572 | A * | 1/1990 | Suzuki | 323/284 |
| 2009/0010661 | A1* | 1/2009 | Hamaya | 399/37 |
| 2010/0080593 | A1 | 4/2010 | Inukai et al. | |
| 2012/0082470 | A1* | 4/2012 | Inukai et al. | 399/31 |

FOREIGN PATENT DOCUMENTS

| | | | | |
|---|---|---|---|---|
| JP | S61-252569 | A | 11/1986 | |
| JP | 63-041875 | A | 2/1988 | |
| JP | H02-155425 | A | 6/1990 | |
| JP | H03-042690 | A | 2/1991 | |
| JP | H04-125667 | A | 4/1992 | |
| JP | 42-07969 | A | 7/1992 | |
| JP | H07-005773 | A | 1/1995 | |
| JP | 90-15944 | A | 1/1997 | |
| JP | 11024371 | A * | 1/1999 | G03G 15/02 |
| JP | H11-024371 | A | 1/1999 | |
| JP | 2007-164033 | A | 6/2007 | |
| JP | 2010-102289 | A | 5/2010 | |
| JP | 2010-156780 | A | 7/2010 | |

OTHER PUBLICATIONS

Japanese Official Action dated Jan. 17, 2013 received from the Japanese Patent Office in related JP 2010-194139.

Japanese Official Action dated Oct. 10, 2013 received in related application JP 2010-194139.

* cited by examiner

*Primary Examiner* — Benjamin Schmitt
(74) *Attorney, Agent, or Firm* — Scully, Scott, Murphy & Presser, P.C.

(57) ABSTRACT

An image forming apparatus includes: a photoconductor; a charger configured to charge the photoconductor, the charger including a discharge wire and a grid; a voltage applying circuit configured to generate charge voltage and apply the charge voltage to the discharge wire of the charger; a grid-current detector configured to detect a grid current passing through the grid; a controller configured to control the voltage applying circuit on the basis of a detection value detected by the grid-current detector so that the grid current is constant; an abnormal-discharge detector configured to detect an abnormal discharge occurring in the charger; and a suppression resistor configured to suppress abnormal discharge energy. The suppression resistor includes a first terminal and a second terminal. The first terminal is connected to the grid. The second terminal is connected to at least one of the grid-current detector and the abnormal-discharge detector.

9 Claims, 5 Drawing Sheets

IMAGE FORMING APPARATUS

CROSS REFERENCE TO RELATED APPLICATION

This application claims priority from Japanese Patent Application No. 2010-194139 filed Aug. 31, 2010. The entire content of this priority application is incorporated herein by reference.

TECHNICAL FIELD

The present invention relates to image forming apparatuses or, specifically, to reducing influence of an abnormal discharge on an image forming apparatus.

BACKGROUND

A typical image forming apparatus has a resistor that suppresses influence of abnormal discharges such as spark discharges. The resistor suppresses occurrence of spark discharges between, for example, a transfer sheet and a photoconductor.

Meanwhile, such a resistor can be adopted in configuration that includes: a charger having a discharge wire and a grid, i.e. a scorotron charger; and a circuit that is connected to the grid and detects abnormal discharge due to dust on the wire of the charger. When adopted in such configuration, the resistor can suppress abnormal discharge energy.

However, as a next step of improvement, there is a need for reducing the abnormal discharge energy while simplifying the circuit configuration having the abnormal-discharge detection circuit connected to the grid of the charger.

SUMMARY

An aspect of the present invention is an image forming apparatus including: a photoconductor; a charger configured to charge the photoconductor, the charger including a discharge wire and a grid; a voltage applying circuit configured to generate charge voltage and apply the charge voltage to the discharge wire of the charger; a grid-current detector configured to detect a grid current passing through the grid; a controller configured to control the voltage applying circuit on the basis of a detection value detected by the grid-current detector so that the grid current is constant; an abnormal-discharge detector configured to detect an abnormal discharge occurring in the charger; and a suppression resistor configured to suppress abnormal discharge energy. The suppression resistor includes a first terminal and a second terminal. The first terminal is connected to the grid. The second terminal is connected to at least one of the grid-current detector and the abnormal-discharge detector.

DETAILED DESCRIPTION

First Illustrative Aspect

A first illustrative aspect will be described with reference to FIGS. 1 and 2.

1. Schematic Configuration of Printer

Figure 1:
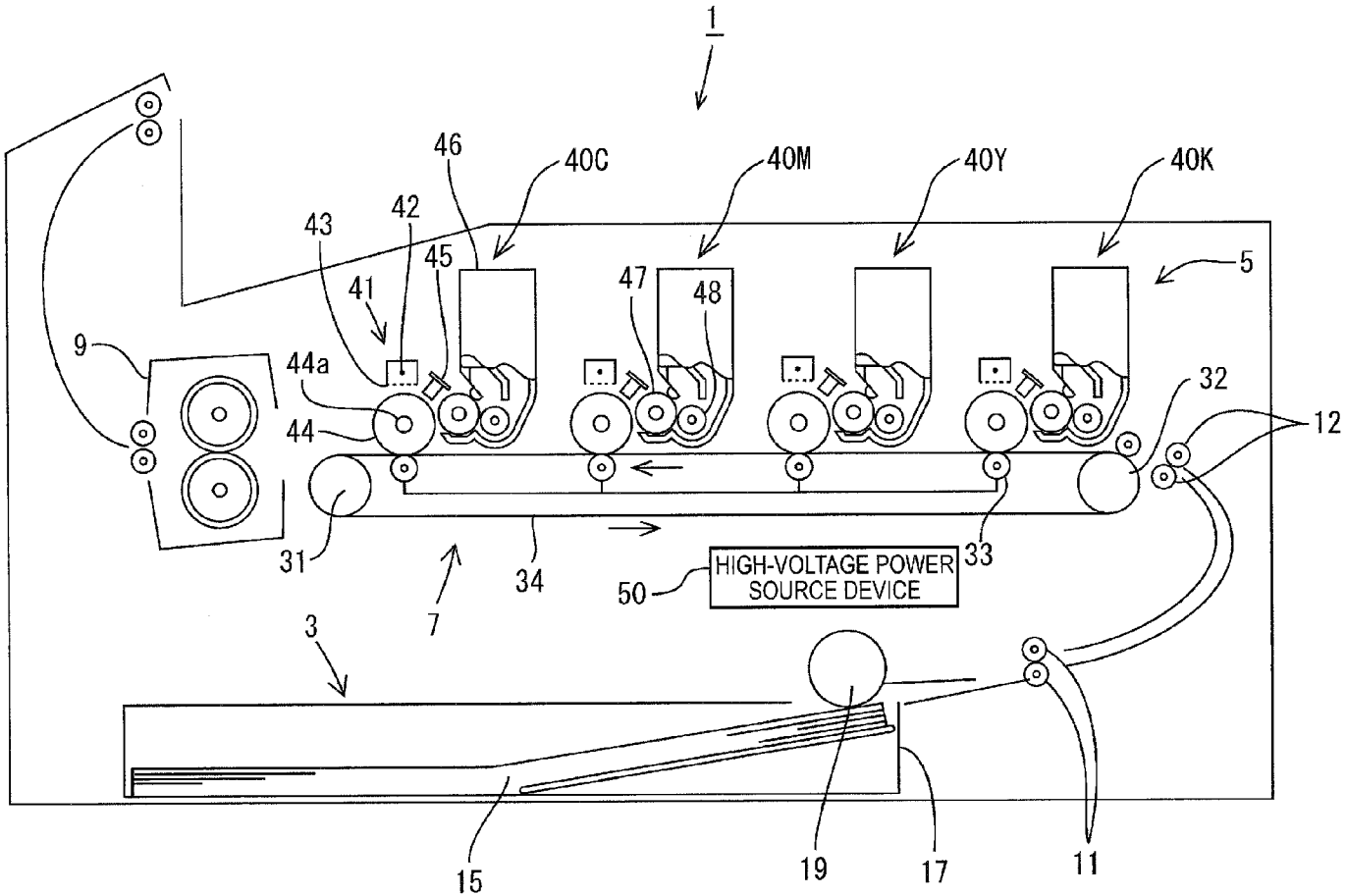
FIG. 1 is a schematic cross sectional view illustrating internal configuration of a printer of a first illustrative aspect.
Figure 2:
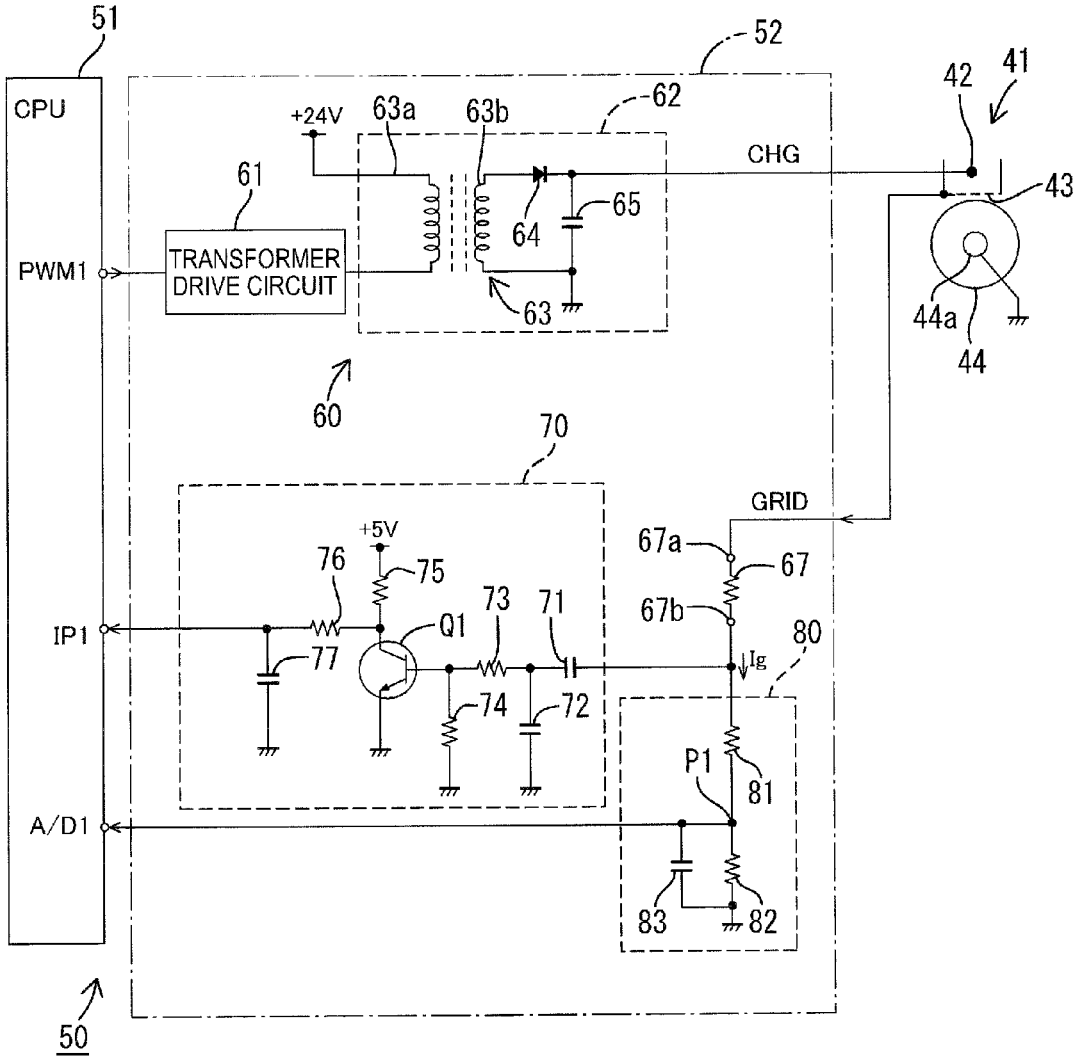
FIG. 2 is a schematic circuit diagram of a high-voltage power source device of the first illustrative aspect.

FIG. 1 is a schematic cross sectional view illustrating internal configuration of a color printer 1 (an illustration of an image forming apparatus) of a first illustrative aspect. Hereinafter, where the components are distinguished by their assigned toner colors, each component will be designated by reference characters accompanied with respective additional characters of Y (yellow), M (magenta), C (cyan), and K (black). On the other hand, where the components are not distinguished by their assigned toner colors, the additional characters are omitted. Note that the image forming apparatus is not limited to the color printer. For example, the image forming apparatus may be a multifunction machine having facsimile and copy functions.

The color printer (hereinafter referred to simply as "the printer") 1 includes a sheet supply unit 3, an image forming unit 5, a conveyer mechanism 7, a fixing unit 9, and a high-voltage power source device 50. The printer 1 forms toner images on sheets 15 (paper sheets, OHP sheets, etc.) according to external input image data and using toner (developer) of a single color or a plurality of (four (yellow, magenta, cyan and black) in this illustrative aspect) colors.

The sheet supply unit 3 is disposed in a bottom portion in the printer 1. The sheet supply unit 3 includes a tray 17 and a pickup roller 19. The tray 17 stores the sheets 15. The pickup roller 19 picks up the sheets 15 one by one from the tray 17. The sheet 15 is then sent to the conveyer mechanism 7 via a conveyer roller 11 and a registration roller 12.

The conveyer mechanism 7 for conveying the sheets 15 is removably mounted to a predetermined mount portion (not illustrated in the figures) in the printer 1. The conveyer mechanism 7 includes a driving roller 31, a driven roller 32, and a belt 34. The belt 34 is looped around the driving roller 31 and the driven roller 32. As the driving roller 31 rotates, the belt 34 moves such that its surface which is opposed to photosensitive drums 44 moves from right to left in FIG. 1. Thus, the sheet 15 sent from the registration roller 12 is conveyed to the image forming unit 5. In addition, the conveyer mechanism 7 includes four transfer rollers 33.

The image forming unit 5 includes four process units 40Y, 40M, 40C, 40K and four exposure devices 45. Each process unit 40 includes a scorotron charger 41, the photosensitive drum (an illustration of a photoconductor) 44, a unit case 46, a developer roller 47, and a supply roller 48. The process units 40Y, 40M, 40C, 40K are removably mounted to respective predetermined mount portions (not illustrated in the figures) in the printer 1.

The photosensitive drum 44 has an aluminium base material and a positively chargeable photosensitive layer on the aluminium base material. The aluminium base material is connected to, for example, the ground line of the printer 1 via a conductive shaft 44*a*. The scorotron charger (hereinafter referred to simply as "the charger") 41 is a charger of a scorotron type, having a discharge wire 42 and a grid 43. Charge voltage CHG is applied to the discharge wire 42. Grid voltage GRID, which is applied to the grid 43, is controlled so that surface potential of the photosensitive drum 44 is substantially uniform (e.g. +700V).

The exposure device 45 has a plurality of light emitting elements (for example, LEDs) that are aligned parallel to the rotation axis of the photosensitive drum 44. The light emitting elements are controlled so as to emit light corresponding to the external input image data, thereby forming an electrostatic latent image on the surface of the photosensitive drum 44. The exposure device 45 is fixedly installed in the printer 1. Note that the exposure device 45 may also be of a laser type.

The unit case 46 stores toner (positively chargeable non-magnetic single-component toner in this illustrative aspect) of the assigned color. The unit case 46 has the developer roller 47 and the supply roller 48. The supply roller 48 rotates to supply the toner to the developer roller 47. The toner is then positively charged by friction between the supply roller 48 and the developer roller 47. Thereafter, the developer roller 47 supplies the toner onto the photosensitive drum 44 to form a uniform and thin layer. Thus, the electrostatic latent image is developed into the toner image on the photosensitive drum 44.

Each transfer roller 33 is arranged in a position in which the transfer roller 33 and the corresponding photosensitive drum 44 hold the belt 34 therebetween. The transfer roller 33 is applied with transfer voltage. The polarity (negative in this illustrative aspect) of the transfer voltage is opposite to the polarity of the charged toner. Thus, the toner image on the photosensitive drum 44 is transferred to the sheet 15. Thereafter, the sheet 15 is conveyed by the conveyer mechanism 7 to the fixing unit 9, where the toner image is fused. Finally, the sheet 15 is ejected onto the upper face of the printer 1.

2. Configuration of High-Voltage Power Source Device

Electrical configuration of the printer 1 related to the present invention will next be described with reference to FIG. 2. FIG. 2 is an illustration of a schematic block diagram of the high-voltage power source device 50 mounted to a circuit board (not illustrated in the figures) and connection configuration related to the high-voltage power source device 50.

The high-voltage power source device 50 includes a CPU (an illustration of a controller) 51 and high-voltage power source circuits 52 connected to the CPU 51. The CPU 51 controls the high-voltage power source circuits 52 and, further, controls over the whole of the printer. Note that the controller is not limited to the CPU; for example, the controller may be an ASIC (application specific integrated circuit).

Each high-voltage power source circuit 52 includes a charge-voltage generation circuit (an illustration of a voltage applying circuit) 60, a suppression resistor 67, and an abnormal-discharge detection circuit (an illustration of an abnormal-discharge detector) 70, and a grid-current detection circuit (an illustration of a grid-current detector) 80. The high-voltage power source circuits 52 are provided to respective chargers 41K-41C. Since the high-voltage power source circuits 52 are identical in configuration, only one of the high-voltage power source circuits 52 is illustrated in FIG. 2.

The charge-voltage generation circuit 60 includes a transformer drive circuit 61 and a step-up circuit 62. The charge-voltage generation circuit 60 generates the charge voltage CHG and applies the charge voltage CHG to the discharge wire 42 of the charger 41. As the charge voltage CHG is applied to the discharge wire 42, discharge occurs from the discharge wire 42 toward the grid 43. This discharge generates the grid voltage GRID in the grid 43. The charge voltage CHG ranges, for example, from 5.5 kV to 8 kV. The grid voltage GRID is, for example, approximately 700 V.

The transformer drive circuit 61 receives, for example, a PWM (pulse width modulation) signal from a port PWM1 of the CPU 51, smoothes the PWM signal and, based on the smoothed PWM signal, applies an oscillation current to a primary winding 63*a* of a transformer 63 of the step-up circuit 62. Then, in this illustrative aspect, the value of the charge voltage CHG is controlled according to the duty ratio of the PWM signal such that, for example, the greater the duty ratio of the PWM signal is, the greater the charge voltage CHG generated by the step-up circuit 62.

The step-up circuit 62 includes, for example, the transformer 63, a rectifier diode 64, and a smoothing capacitor 65, With this configuration, the voltage in the primary winding 63*a* of the transformer 63 is stepped up via a secondary winding 63*b* and is rectified and smoothed by the rectifier diode 64 and the smoothing capacitor 65, so that the charge voltage CHG is generated. The charge voltage CHG is applied to the discharge wire 42 of the charger 41.

The abnormal-discharge detection circuit 70 detects occurrence of a spark discharge (an illustration of an abnormal discharge) in the charger 41 by detecting an abnormal-discharge current that momentarily passes through the charger 41 due to the spark discharge. The abnormal-discharge detection circuit 70 can be configured by a known circuit such as illustrated in FIG. 2.

The abnormal-discharge detection circuit 70 includes, for example, a coupling capacitor 71, capacitors 72, 77, resistors 73, 76, bias resistors 74, 75, a transistor Q1, etc.

The coupling capacitor 71 receives the abnormal discharge current due to the spark discharge in the charger 41. Specifically, upon occurrence of the spark discharge between the discharge wire 42 and the grid 43, a grid current Ig that passes through the grid 43 varies intermittently and greatly. Then, while the coupling capacitor 71 extracts the AC component of the grid current Ig, the transistor Q1 turns on/off according to the AC component. More specifically, the transistor Q1 turns on at every occurrence of the spark discharge between the discharge wire 42 and the grid 43 at a predetermined level or greater. The CPU 51 reads an OFF signal from the transistor Q1 via an input port IP1, thereby detecting occurrence of the spark discharge.

The grid-current detection circuit 80 includes a voltage dividing resistor (an illustration of a voltage dividing element) 81, a grid-current detection resistor 82, and a capacitor 83. The grid-current detection circuit 80 detects the grid current Ig passing through the grid 43. An end of the grid-current detection resistor 82 is connected to the voltage dividing resistor 81, while the other end is grounded. Then, the value of the voltage at a connection point P1 connecting the voltage dividing resistor 81 and the grid-current detection resistor 82 is supplied to a port A/D1 of the CPU 51 as a detection signal corresponding to the grid current Ig. Note that the capacitor 83 has a function of averaging the grid current Ig.

The CPU 51 controls the charge-voltage generation circuit 60 on the basis of the value detected by the grid-current detection circuit 80 so that the grid current Ig is constant. This stabilizes the operation of charging the photosensitive drum 44. The grid current Ig is detected using the detection value detected by the grid-current detection resistor 82 (the detection voltage value) and the resistance of the grid-current detection resistor 82.

The suppression resistor 67 has a first terminal 67*a* and a second terminal 67*b*. The suppression resistor 67 can suppress abnormal discharge energy upon occurrence of the spark discharge in the charger 41. The resistance of the suppression resistor 67 is, for example, 1 (one) MΩ. The first terminal 67*a* is connected to the grid 43 of the charger 41. The second terminal 67*b* is connected to at least one of the grid-current detection circuit 80 and the abnormal-discharge detection circuit 70. In this illustrative aspect, the second terminal 67*b* is connected to the grid-current detection circuit 80 and the abnormal-discharge detection circuit 70. Specifically, the second terminal 67*b* is connected to the voltage dividing resistor 81 of the grid-current detection circuit 80 and the coupling capacitor 71 of the abnormal-discharge detection circuit 70.

3. Effects of First Illustrative Aspect

Thus, in the first illustrative aspect, the suppression resistor 67 is connected between the grid 43 and the abnormal-discharge detection circuit 70 and the grid-current detection circuit 80. In other words, the suppression resistor 67, which consumes the abnormal-discharge energy to reduce (suppress) the discharge energy upon occurrence of the abnormal discharge such as the spark discharge in the charger 41, is connected in the grid voltage line. Note that, in regard with the location of the suppression resistor 67 from the standpoint of maintaining the grid voltage GRID constant, providing the suppression resistor 67 in the discharge voltage line (i.e. between the charge-voltage generation circuit 60 and the charger 41) is also conceivable. However, the charge voltage CHG (ranging from 5.5 kV to 8 kV) is rather higher than the grid voltage GRID (approximately 700 V). Therefore, when the suppression resistor 67 is provided in the grid voltage line, a low withstand-voltage and small-sized resistor can be used as the suppression resistor 67. Furthermore, in comparison with providing the suppression resistor 67 in the discharge voltage line, reduction in the charge voltage CHG due to voltage drop by the suppression resistor 67 can be avoided.

Furthermore, the voltage drop by the suppression resistor 67 can reduce the grid voltage GRID applied to the abnormal-discharge detection circuit 70 and the grid-current detection circuit 80. Specifically, the suppression resistor 67 can function also as a further voltage dividing element of the grid-current detection circuit 80. This makes it possible to use a still lower withstand-voltage resistor as the voltage dividing resistor 81. Furthermore, because the grid voltage GRID is divided by the suppression resistor 67 and the coupling capacitor 71, the stress (the electrical load) exerted on the coupling capacitor 71 can be reduced.

Thus, this illustrative aspect makes it possible to suitably simplify the circuit configuration having the abnormal-discharge detection circuit 70 connected to the grid 43 of the scorotron charger 41 while suppressing the abnormal discharge energy.

Second Illustrative Aspect

Next, a second illustrative aspect in accordance with the present invention will be described with reference to FIG. 3. The second illustrative aspect differs from the first illustrative aspect only in the connection configuration of the suppression resistor 67 in a high-voltage power source circuit 52A. Therefore, the configuration identical with the high-voltage power source circuit 52 of the first illustrative aspect will be designated with the identical reference characters, while the description will be omitted.

Figure 3:
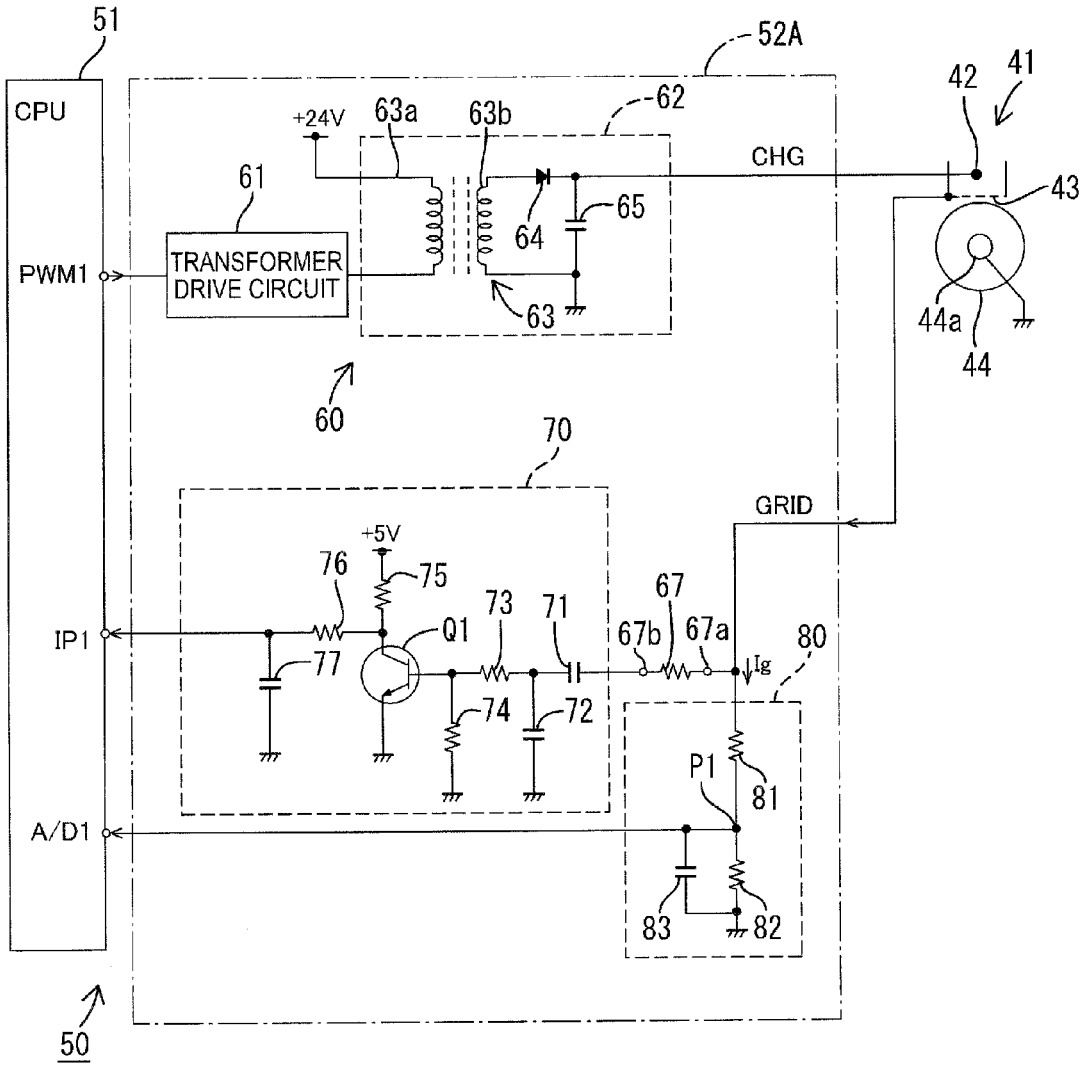
FIG. 3 is a schematic circuit diagram of a high-voltage power source device of a second illustrative aspect.

Namely, in the second illustrative aspect, the first terminal 67*a* of the suppression resistor 67 is connected to the grid 43 and the grid-current detection circuit 80, while the second terminal 67*b* of the suppression resistor 67 is connected to the abnormal-discharge detection circuit 70 as illustrated in FIG. 3. Specifically, the first terminal 67*a* is connected to the grid 43 and the voltage dividing resistor 81 of the grid-current detection circuit 80, while the second terminal 67*b* is connected to the coupling capacitor 71 of the abnormal-discharge detection circuit 70.

This connection configuration of the suppression resistor 67 makes it possible to provide the suppression resistor 67 in the grid voltage line while little affecting the grid-current detection circuit 80. Furthermore, because the suppression resistor 67 and the coupling capacitor 71 divide the grid voltage GRID, the stress (the electrical load) exerted on the coupling capacitor 71 can be reduced.

Third Illustrative Aspect

Figure 4:
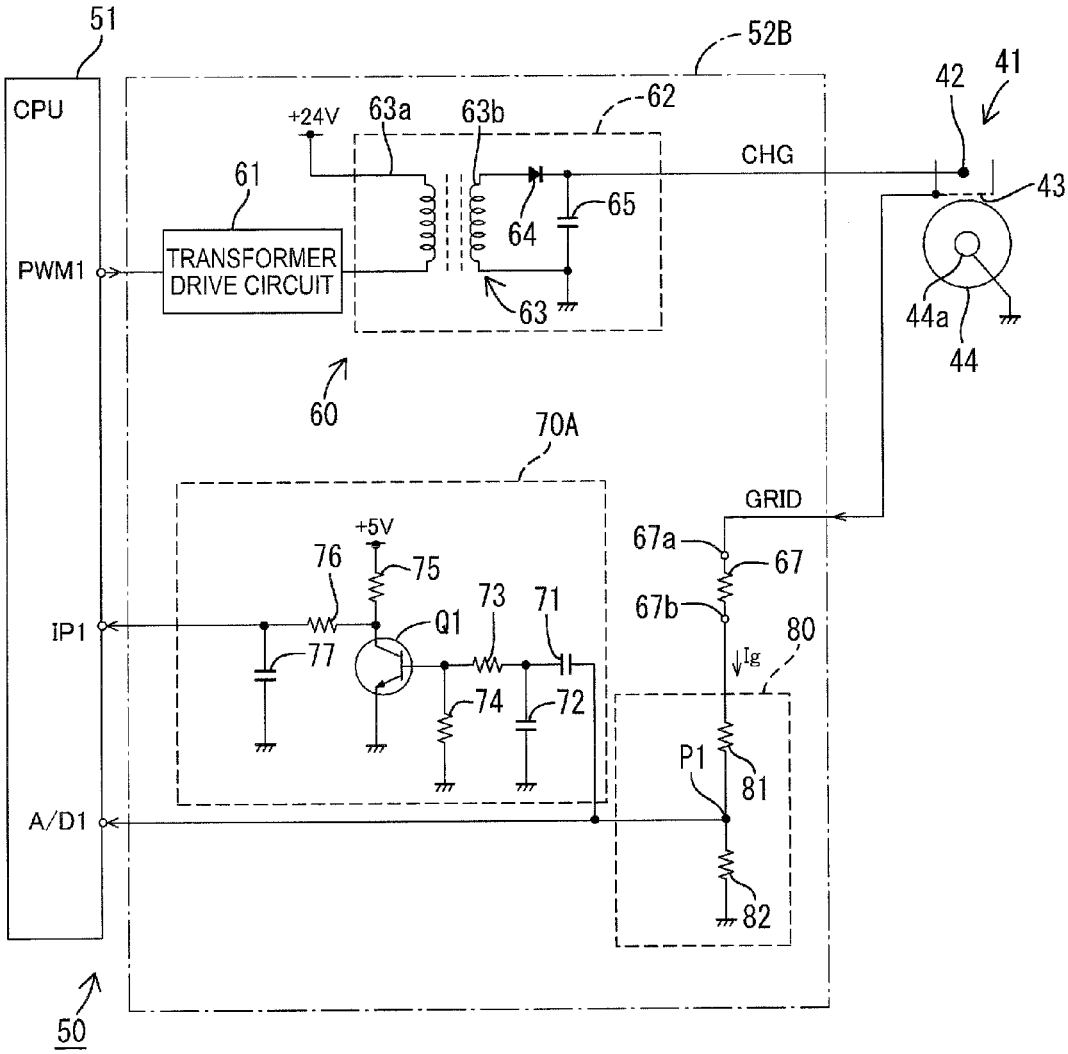
FIG. 4 is a schematic circuit diagram of a high-voltage power source device of a third illustrative aspect.

Next, a third illustrative aspect in accordance with the present invention will be described with reference to FIG. 4. The third illustrative aspect differs from the first illustrative aspect only in the configuration related to the connection of the abnormal-discharge detection circuit 70 in a high-voltage power source circuit 52B. Therefore, the configuration identical with the high-voltage power source circuit 52 of the first illustrative aspect will be designated with the identical reference characters, while the description will be omitted.

In the high-voltage power source circuit 52B of the third illustrative aspect, the coupling capacitor 71 of the abnormal-discharge detection circuit 70 is connected to the connection point P1 connecting an end of the voltage dividing resistor 81 of the grid-current detection circuit 80 and an end of the grid current detection resistor 82. In addition, the grid-current detection circuit 80 lacks the capacitor 83 illustrated in FIG. 2.

Thus, in the configuration of connecting the coupling capacitor 71 of an abnormal-discharge detection circuit 70A to the connection point P1 in the grid-current detection circuit 80, the coupling capacitor 71 and the capacitor 72 of the abnormal-discharge detection circuit 70A can function also as the capacitor 83 (can average the grid current Ig). Therefore, the grid-current detection circuit 80 can lack the capacitor 83, so that the circuit configuration can be further uncomplicated.

Other Illustrative Aspects

Figure 5:
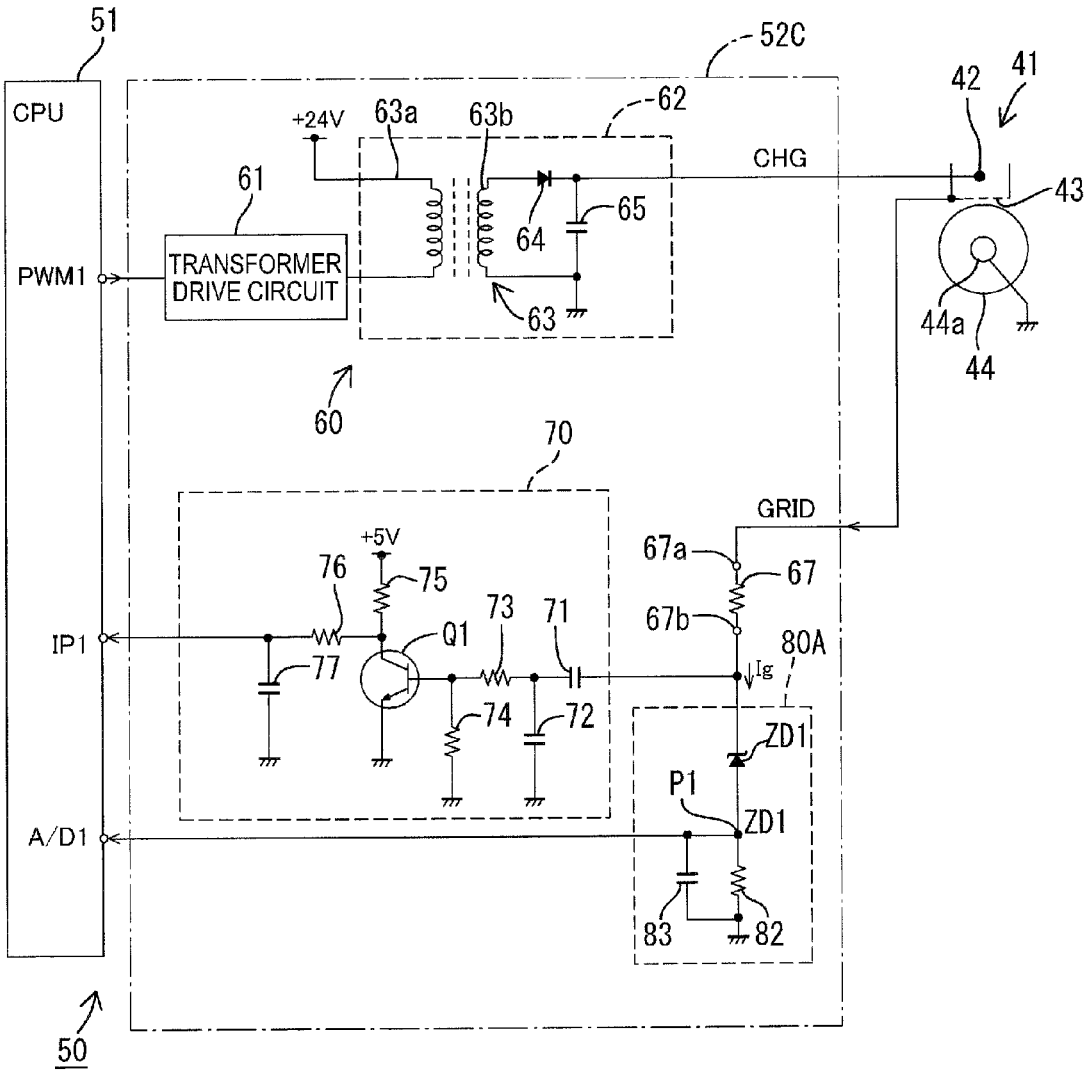
FIG. 5 is a schematic circuit diagram of a high-voltage power source device of another illustrative aspect.

The present invention is not limited to the above illustrative aspects with reference to the drawings. For example, the following illustrative aspect are also within the scope of the present invention:

(1) In the above first and third illustrative aspects, the voltage dividing element of the grid-current detection circuit 80 is configured by the voltage dividing resistor 81. The present invention is not limited to this. For example, the voltage dividing element can be configured by a voltage regulating element. For example, as illustrated in FIG. 5, the voltage dividing element may be configured by a zener diode ZD1. The zener diode ZD1 then can maintain the grid voltage GRID constant to some extent (i.e. under influence of voltage drop by the suppression resistor 67) under constant current control of the grid current Ig.

What is claimed is:

1. An image forming apparatus, comprising:

a photoconductor;

a charger configured to charge the photoconductor, the charger including a discharge wire and a grid;

a voltage applying circuit configured to generate charge voltage and apply the charge voltage to the discharge wire of the charger;

a grid-current detector configured to detect a grid current passing through the grid, the grid-current detector including a voltage dividing element and a grid-current detection resistor that is connected between a first end of the voltage dividing element and a ground;

a controller configured to control the voltage applying circuit on the basis of a detection value detected by the grid-current detector so that the grid current is constant;

an abnormal-discharge detector configured to detect an abnormal discharge occurring in the charger; and a suppression resistor configured to suppress abnormal discharge energy, the suppression resistor including a first terminal and a second terminal, the first terminal connected to the grid, the second terminal connected to at least one of: (a) a second end of the voltage dividing element of the grid-current detector; and (b) the abnormal-discharge detector.

2. An image forming apparatus, comprising:

a photoconductor;

a charger configured to charge the photoconductor, the charger including a discharge wire and a grid;

a voltage applying circuit configured to generate charge voltage and apply the charge voltage to the discharge wire of the charger;

a grid-current detector configured to detect a grid current passing through the grid;

a controller configured to control the voltage applying circuit on the basis of a detection value detected by the grid-current detector so that the grid current is constant;

an abnormal-discharge detector configured to detect an abnormal discharge occurring in the charger; and a suppression resistor configured to suppress abnormal discharge energy, the suppression resistor including a first terminal and a second terminal, the first terminal connected to the grid, the second terminal connected to the abnormal-discharge detector and the grid-current detector.

3. The image forming apparatus according to claim 2, wherein:

the abnormal-discharge detector includes a coupling capacitor configured to receive an abnormal discharge current due to the abnormal discharge;

the grid-current detector includes a voltage dividing element and a grid-current detection resistor that is connected between an end of the voltage dividing element and the ground; and the second terminal of the suppression resistor is connected to the coupling capacitor of the abnormal-discharge detector and the voltage dividing element of the grid-current detector.

4. The image forming apparatus according to claim 3, wherein:

the voltage dividing element includes a constant-voltage element; and the grid-current detector detects the grid current at a connection point connecting the constant-voltage element and the grid-current detection resistor.

5. The image forming apparatus according to claim 1, wherein:

the first terminal of the suppression resistor is connected to the grid and the grid-current detector; and the second terminal of the suppression resistor is connected to the abnormal-discharge detector.

6. The image forming apparatus according to claim 5, wherein:

the abnormal-discharge detector includes a coupling capacitor configured to receive an abnormal discharge current due to the abnormal discharge; and the second terminal of the suppression resistor is connected to the coupling capacitor.

7. The image forming apparatus according to claim 1, wherein:

the abnormal-discharge detector includes a coupling capacitor configured to receive an abnormal discharge current due to the abnormal discharge;

the grid-current detector includes the voltage dividing element and the grid-current detection resistor that is connected between the first end of the voltage dividing element and the ground;

the second terminal of the suppression resistor is connected to the second end of the voltage dividing element; and the grid-current detector detects the grid current at a connection point connecting the first end of the voltage dividing element and the grid-current detection resistor; and the coupling capacitor is connected to the connection point.

8. The image forming apparatus according to claim 7, wherein:

the voltage dividing element includes a constant-voltage element.

9. The image forming apparatus according to claim 1, wherein the voltage dividing element is a voltage dividing resistor.

* * * * *